XR 3,958,276 SR

United States Patent [19]

Clausen

[11] 3,958,276

[45] May 25, 1976

[54] HELMET

[76] Inventor: Carol W. Clausen, 1715 E. Florence Ave., Los Angeles, Calif. 90001

[22] Filed: July 9, 1975

[21] Appl. No.: 594,351

[52] U.S. Cl. ..... 2/2.5

[51] Int. Cl.[2] ..... F41H 1/02

[58] Field of Search ..... 2/2, 2.5, 6; 428/911, 428/245, 246; 89/36 D

[56] References Cited

UNITED STATES PATENTS

| | | | |
|---|---|---|---|
| 2,351,235 | 6/1944 | Shroyer et al. | 2/6 |
| 3,018,210 | 1/1962 | Frieder et al. | 2/2.5 |
| 3,320,619 | 5/1967 | Lastnik et al. | 2/2.5 X |
| 3,562,810 | 2/1971 | Davis | 2/2.5 |
| 3,582,990 | 6/1971 | Frieder | 2/6 |
| 3,722,355 | 3/1973 | King | 2/2.5 X |
| 3,771,418 | 11/1973 | Gulbierz et al. | 428/911 X |
| 3,855,632 | 12/1974 | Davis | 2/2.5 |

*Primary Examiner*—Alfred R. Guest
*Attorney, Agent, or Firm*—Georges A. Maxwell

[57] ABSTRACT

A bullet-proof body-protecting wall structure comprising a thin resilient pressure molded, outer skin of resin impregnated layers of flexible woven fabric with inner and outer surfaces, a non-integrated laminated flexible woven fabric core with inner and outer surfaces arranged with its outer surface adjacent the inner surface of the outer skin to yieldingly support said skin against inward deflection and a soft resilient inner liner with inner and outer surfaces and arranged with its outer surface adjacent the inner surface of the core to yieldingly support said core against inward deflection, said inner surface of the inner lines adapted to be disposed substantially adjacent to a portion of the body to be protected and said outer surface of the outer skin adapted to be disposed substantially normal and opposite to the line and direction of flight of a bullet directed toward said portion of the body.

7 Claims, 12 Drawing Figures

Kevlar

H
S
F
F'
C
20
21
I

I
C
F
B
S
F'

I
C
S
B
A

S
I
A
C
14

V

I
C
F'
F
S
B
B'

A
B
S
I
C
B2

HELMET

This invention has to do with a body protecting structure and is more particularly concerned with an improved wall structure for helmets and body protecting panels which is bullet-proof.

In recent years, considerable attention has been given to the protection of law enforcement officers and the like from bodily injury by gun shot.

Notable advances in the art here concerned with have been the provision of body protecting garments in the nature of aprons or vests adapted to overlay the chest and abdomen of a wearer and which are such that they effectively stop the advance of gun shot. Such garments are commonly referred to as bullet-proof vests.

The most recent advance in the art of bullet-proof vests has been the establishment of vests comprising panel sections of loose or unsecured layers of special, strong and durable fabric. The fabric employed is woven of Kevlar 29 fiber, produced by DuPont and which is purported to be in excess of five times stronger than common Nylon fiber. The laminated panels include in excess of a dozen loose layers of fabric and are supported in a non-backed or no-back-up supported condition. It has been determined that such vest or panel structures are effective to stop and prevent the penetration of bullets fired from most hand-guns. The ability of such vests to stop the bullets fired from certain of the more high powered firearms, such as 357 Magnums or from 9 millimeter pistols using high velocity copper jacketed ammunition, is still considered questionable.

The above noted vests are soft, flexible and lightweight, which makes them quite effective and desirable for regular daily use.

While reasonably effective body protection is afforded by the above referred to vests, the prior art has yet to provide a helmet which is bullet proof.

The ordinary or conventional protective helmets provided for peace officers and the like comprise a rigid outer shell which is capable of withstanding considerable, low velocity widely distributed impact forces without breakage or failure. The shells of such helmets are provided with liners of soft, compressible, compactable force-absorbing foam plastic, to yieldingly compact and dissipate forces which are imposed upon the exterior of the skull and transmitted from the shell to the head off the wearer. In addition, such helmets include interior head-engaging band and strap means to facilitate relating the helmets to the heads of the wearers.

Helmets such as referred to above afford little or no resistance to penetration of bullets fired from hand guns and afford no real protection for the wearers' heads against injuries or death by gun shot.

It is significant and important to note at this time that the success of the aforementioned laminated fabric panel type bullet-proof vest structures resides in the fact that the rear or inside surfaces of the panel structures are not rigidly supported, but rather, are supported, if at all, by the soft, readily yieldable body or torso of the wearer, whereby the panels are relatively free to yield and move inwardly upon impact of bullets at their outer surfaces and in the course of their receiving, distributing and absorbing the force of the bullets.

As a result of the above required capability of laminated fabric bullet-proof panels to yield and move relatively freely in the direction of and in advance of bullets impinging upon them, such laminated fabric structures are ineffective to protect the heads of wearers wherein the laminate structures are backed and substantially non-yieldingly supported at their inside surfaces by the rigid skull structures of the wearers.

Tests that I have conducted clearly demonstrate that a multiplicity of layers (12 or more) of Kevlar 29 fabric normally supported at the inside surface of the laminate structure by a supporting head form structure equivalent in mass and rigidity to the human head, is readily penetrated by bullets from hand-guns. Further, tests wherein the layers of Kevlar 29 fabric supported on a head form were encased within an outside shell of conventional molded plastic or plastic impregnated fiber glass met with the same results. Still further, tests wherein the layers of Kevlar 29 fabric were arranged within the shells of conventional helmets and were separated from related head forms by yieldingly compactable, non-resilient shock-absorbing liner material such as is commonly employed in safety helmets, also met with the same, above noted, unsatisfactory results. In these last mentioned tests, the shock absorbing, non-resilient liner material compacted under the applied forces to establish a substantially rigid, firm support for the laminated fabric and the establishing of conditions which resulted in apparent easy penetration of test-bullets fired at and into the test helmet structures.

In May of 1975, the United States Department of Justice, in conjunction with the Law Enforcement Assistance Administration and National Institute of Law Enforcement and Criminal Justice, published preliminary and/or initial standards for bullet-proof helmets, entitled NILECJ Standards for Ballistic Helmets. The noted publication is for sale by the Superintendent of Documents, U.S. Government Printing Office, Washington, D.C. 20402; Stock Number NILECJSTD - 0105.00.

The standards which are set forth in the above identified publication were formulated in anticipation of the future requirements for bulletproof helmets and it is understood that the noted standards are not based upon any helmet or helmet structures that have developed in the art and which are capable of stopping penetration of bullets fired from hand-guns and which impinge upon them. Rather, it is understood that the noted standards were developed and formulated to set forth the tests which must be met and passed in order that a helmet structure, yet to be provided, be rated as bullet-proof.

The most stringent or demanding standards which have been formulated pertain to head form supported helmets which will stop and prevent penetration of a 158 grain 0.357 Magnum lead bullet traveling at 1387 feet per second and fired from a 6.5 inch barrel 357 Magnum hand-gun spaced 10 feet from the helmet. Not only must the helmet prevent penetration of the bullet, but no measured peak acceleration of the helmet and head form assembly can exceed 400 gn (400 times the acceleration due to gravity). The tests required to meet the noted standards require that the angle of flight of the bullet be no greater than 5° from perpendicular to the plane tangent to the point of impact and that no hit need be closer than 2 inches from a prior hit. Penetration is to be determined and/or measured by the passage of light from a 60 watt electric lamp at the point of impact, that is, if light from a 60 watt lamp at the point of impact is visible at the inside of the helmet tested, the helmet will have failed test requirements and to meet the standards set.

An object of my invention is to provide a novel wall structure suitable for the establishment of helmets and body protecting vest panels and the like, which wall structure is capable of effectively and dependably stopping and preventing the penetration of bullets fired from hand-guns and impinging upon the helmets, vests and the like.

It is an object and feature of my invention to provide a wall structure of the character referred to which, when embodied in a helmet, establishes a bullet-proof helmet which clearly possesses and far exceeds the most stringent and rigid standards for bullet-proof or ballistic helmets which have been formulated and adopted by the U.S. Department of Justice, Law Enforcement Assistance Administration and National Institute of Law Enforcement and Criminal Justice.

It is an object and feature of my invention to provide a wall structure of the character referred to which comprises an outer laminated shell or skin, a central or intermediate laminated core and an inner or rear liner.

More specifically, it is an object and feature of my invention to provide a wall structure of the character referred to above wherein the outer shell is established of a plurality of layers or sheets of woven fabric of high temperature resistant and high tensile strength long chain polyester resin fibers, said layers being impregnated and bonded together by a semi-rigid non-frangible resin; said central core is established of layers or sheets of woven fabric of high tensile strength long chain polyester resin fibers, and arranged in loose, non-compressed adjacent relationship with each other; and, said inner liner comprises a sheet or lamination of sheets of soft, compressible resilient foam plastic or the like.

It is a further object and feature of my invention to provide a wall structure of the character referred to above wherein the outer skin slows and initiates deformation and flattening of a bullet fired at and impinging upon the shell; the outermost layers of fabric of the core progressively slow and further deform or flatten the bullet and yieldingly deflect inwardly in that area or portion about the bullet to absorb and distribute forces imparted by the bullet over an ever-increasing area, the innermost layers of fabric of the core yieldingly deform and displace inwardly under the forces distributed by said outermost layers to absorb forces directed thereto and said resilient inner liner yieldingly backs and yieldingly accommodates the inwardly displaced portions of the core adjacent thereto.

It is an object and feature of my invention to provide a wall structure of the character referred to above wherein the outer skin can be effectively established with as little as three layers of Kevlar 29 fabric, said core can be established with as few as 8 layers of Kevlar 29 fabric to establish a wall structure wherein a 357 Magnum bullet fired at the structure in accordance with the above noted standards testing procedures will not penetrate beyond the outer three fabric layers of the core.

It is to be noted that in the aforementioned bullet-proof vest structure provided by the prior art, as many as 16 layers of Kevlar 29 fabrics are employed. Those vests will not dependably prevent or stop penetration of a 357 Magnum bullet fired under conditions similar to the tests provided for in the aforementioned standards for helmets. If such bullets are stopped by such vests, tests that I have conducted show that the bullets pass through or penetrate about 12 layers of the fabric. In light of the above, it will be noted that twice the number of layers of Kevlar 29 fabric are penetrated by a 357 Magnum bullet in a vest of loose of unsecured fabric layers than are penetrated in my structure wherein the first several of the layers of fabric are impregnated and bonded together by a suitable resin plastic to establish a sim, rigid outer shell or skin.

In furtherance of the present invention, it has been found to be particularly advantageous to provide a semi-rigid inner shell or skin of resin impregnated and bonded fabric layers arranged between the above noted laminated fabric core and resilient inner liner. In addition to containing and/or retaining the core structure, an inner shell or skin provides a desirable support structure for the inner liner and has proved to serve the most effective and desirable function of absorbing and distributing the forces transmitted thereto by an impinging bullet, through the core structure, radially relative to the axis of travel of the bullet and to distribute such forces over a greater area of the resilient inner liner.

In practice, the inner shell or skin is preferably lighter and less rigid than the outer shell or liner and comprises but two layers of Kevlar 29 fabric.

In carrying out the present invention, the resin employed to impregnate and bond the fabric laminates of the inner and/or outer shells or skins is such that its indexes of shear and tension are greater than those of the fabric fibers whereby said resin serves to support and reinforce the fabric layers or the fibers thereof, but is such that forces applied to the shells sufficient to cause the resin to break down or yield will not break the fibers, thereby permitting the fabric to impart its maximum effect to absorb and distribute forces imparted thereto by a bullet impinging upon it.

In accordance with the foregoing, it is an object and feature of my invention to provide a wall structure of the character referred to in the preceding which further includes a semi-rigid, flexible, resin impregnated laminated fabric inner shell or skin between the core and the resilient liner and to provide such an inner shell or skin wherein the tensile and shear strength of the fabric fibers is greater than the tensile and shear strength of the resin.

In the instant invention, as in the case of the noted bullet-proof vests provided by the prior art, the energy of the bullet impinging about and stopped by the structures is converted into heat which heat is substantial and is sufficient to sear, soften and melt most resins commonly employed to establish fiber for woven fabrics. The high temperatures encountered are generated almost instantly in and through the fibers of the fabric in advance of a bullet and are such that in the case of fabric or fibers having lower melting points, bullets will substantially directly penetrate laminates of fabric by softening and stretching aside or melting the fabric fibers in their path.

In light of the above, it is necessary that the fabric employed in carrying out my invention be established of fiber having a high melting point.

At the time of drafting this disclosure, data pertaining to the tensile strength, shear strength and melting point of Kevlar 29 fabrics produced and marketed by Du- Pont, which is that fabric which has proved to be effective and satisfavtory in practice of the invention, was not available to me. However, in the simple comparison tests that I have conducted, it was easily and readily determined that Kevlar 29 fabric is many times stronger (about 5 times) in both shear and in tension and has a far greater or higher melting point than does Balasa Nylon fabric produced by the same manufacturer.

In test helmet structures utilizing Balasa Nylon fabric instead of Kevlar 29 fabric, the helmet structures would not prevent penetration of 357 Magnum bullets. In those test helmet structures, the Balasa Nylon fibers showed clear evidence of having been softened, stretched and melted by the heat generated by impinging bullets which passed therethrough.

In test helmet structures embodying my invention and utilizing Kevlar 29 fabric, there was noticeably less and neglible visual signs or evidence of effects of heat in the structures where bullets impinged and were stopped.

With the data available to me at this time, and which has been attained primarily from visual examination of test structures, it is believed that the high heat resistant characteristics, tensile and shear strength of the fabric (or its fibers) employed are quite important in carrying out my invention and that the fabric or fabrics employed should have a tensile and shear strength and should have a melting point which are the same or near to the tensile and shear strength and the melting point of Kevlar 29 fabric.

It is a major object and feature of my invention to provide a bullet-proof helmet structure of the character referred to above which is such that it can be easily and effectively made in those sizes, shapes and within those weight limitations which have become acceptable, adopted and made standard for safety helmets.

The foregoing and other objects and features of my invention will be fully understood and will be apparent from the following detailed description of typical preferred forms and carrying out of my invention throughout which description reference is made to the accompanying drawings, in which.

Figure 1:
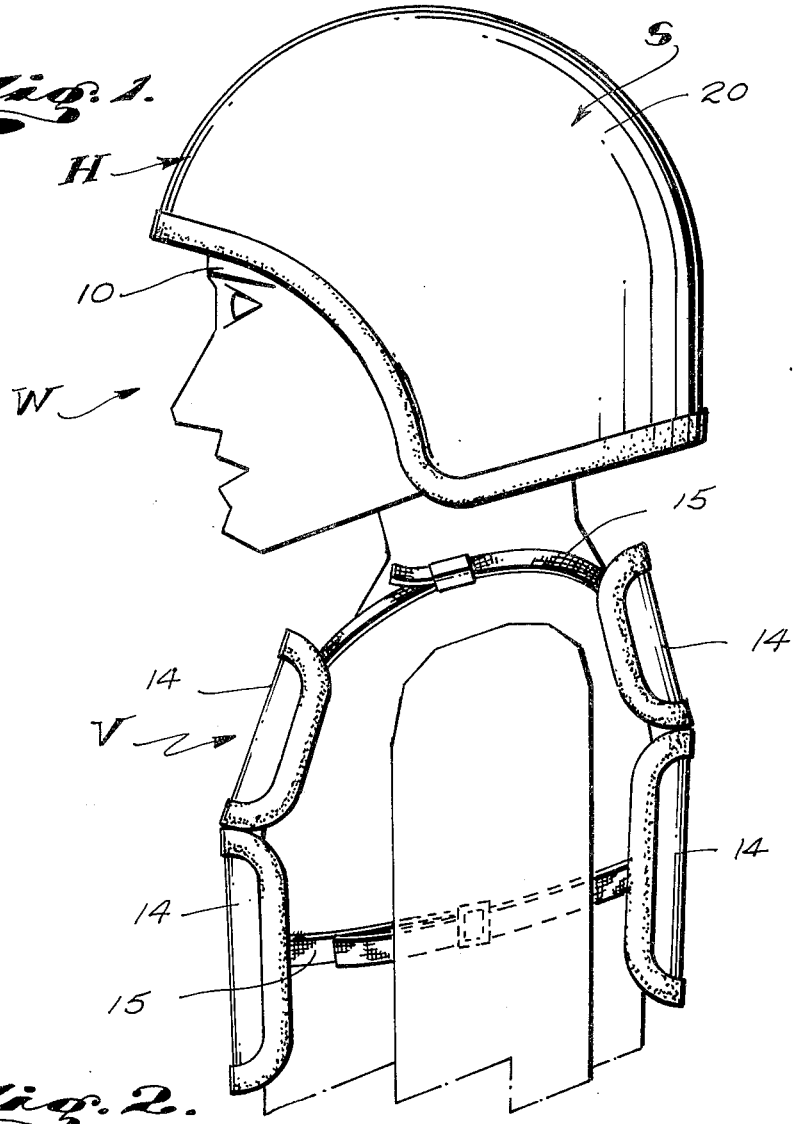
FIG. 1 is a side elevational view showing a helmet and a vest embodying the present invention related to the head and the chest portion of a wearer.

As shown in FIG. 1 of the drawings, the wall structure that I provide is such that it can be advantageously formed and/or used to establish a bullet-proof helmet H engageable on and about the head 10 of a person or wearer W and can be formed and/or used to establish a bullet-proof vest V related to the chest or upper torso 11 of the wearer W.

The helmet H can be established in substantially any suitable form or shape and is preferably established in one of those several forms or shapes which have been adopted and standardized in the art of protective helmets. As a general rule, and as illustrated in the drawings, the helmet includes an upper substantially semi-spherical, downwardly opening concavo-convex crown portion engageable about the top of the wearer's head and a lower side and rear shirt portion about and extending downwardly from the lower side and rear of the top portion to overlay the temporal and lower base portions of the wearer's head and which generally serves to further protect the rear and lateral portions of the upper neck.

In practice, the helmet H is provided with interior, adjustable band and/or strap type head engaging means to facilitate relating the helmet to the wearer's head and can, in accordance with common practice, be provided with chin strap means, visor mounting means and the like. Since the above noted means in no way affect or constitute a part of my invention, I have elected not to burden this disclosure with illustrations and detailed description thereof, which illustrations and description could only serve to cloud or obscure the invention.

In practice, the vest V can be established of panels 14 suitably formed to most effectively overlay the portion of the wearer's body or torso with which they are related and secured together in articulated relationship and supported on the wearer's body by suitable strap means 15. Since the present invention relates to the wall structure of the panels 14 and is not affected by the specific configuration of the panels, the relationship of the panels to each other or the other related means that are required to establish a suitable vest construction, I have elected not to burden this disclosure with details of a particular vest structure, it being understood that the invention can be embodied in any vest structure which utilizes or is composed of semi-rigid panels.

Figure 2:
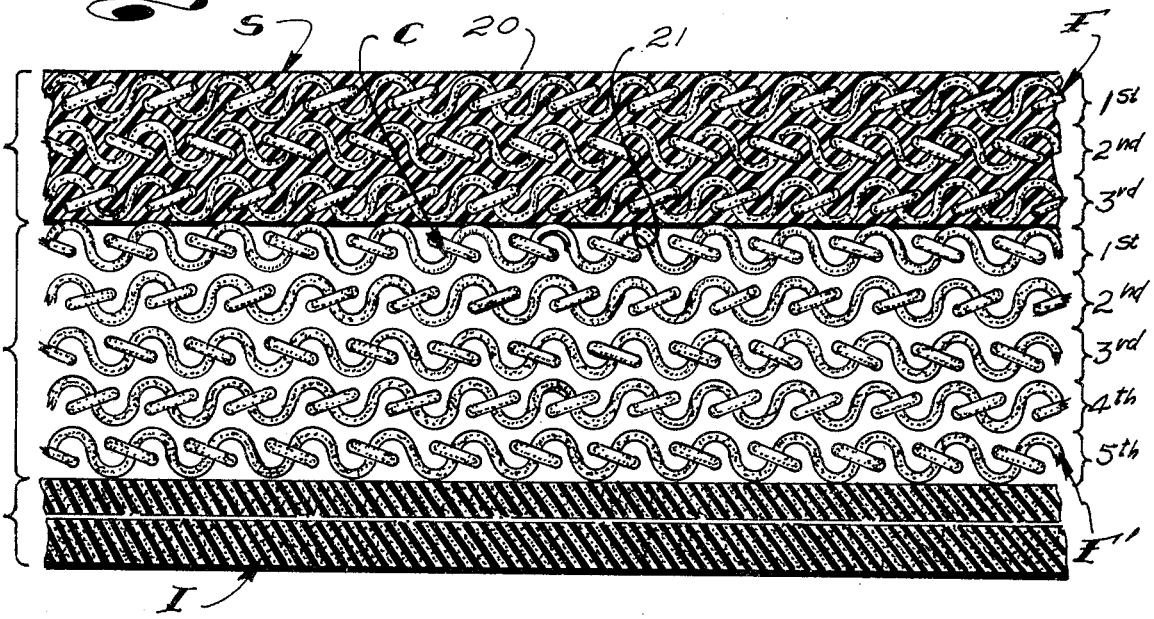
FIG. 2 is an enlarged detailed sectional view of the wall structure that I provide.

Referring to FIG. 2 of the drawings, the wall structure A that I provide includes an outer shell or skin S, a central or intermediate core C and an inner liner I. The shell or skin S has substantially flat outside and inside surfaces 20 and 21. The surface 20 is initially engaged by a bullet fired at and which impinges upon the wall structure.

The skin S is a semi-rigid unitary laminate structure comprising a plurality of layers of fabric F impregnated and bonded together by a suitable resin plastic.

In practice, the fabric F is a fabric of substantial weight, and is woven of long chain polyester resin fibers having high tensile and shear strength and has a high melting point.

The fabric can, for example, be 8 oz. Kevlar 29 fabric, mill 713/45, produced by DuPont, or a fabric having near the same strength and heat resilient characteristics.

In practice, the skin S is composed of a limited number of layers of fabric whereby the skin is sufficiently non-rigid or flexible so that upon the application of impact forces of a bullet impinging upon the surface 20 thereof, the skin will readily yieldingly flex inwardly throughout the area about the point of impact and thereby absorb and distribute or dissipate a substantial portion of the impact forces.

Further, the resin employed to establish the skin S is preferably a non-brittle or flexible resin which will readily allow for the above-noted flexure of the skin and is weaker in shear and in tension than the fibers of the fabric F, whereby the fabric can be readily drawn and pulled free from within the mass of resin before shearing and/or being separated, by drawing, in advance and under the impact of a bullet.

In other words, the resin is of insufficient strength, stiffness and/or hardness to hold the fabric so securely and fixed as to result in the concentration of the forces of an impinging bullet to the immediate area of impact of the bullet, which concentration of forces would result in excessive shearing forces on the fibers of the fabric and materially reduce the effectiveness of the fabric to absorb forces before yielding thereto.

In practice, the skin or shell is formed and the resin is cured in a suitable mold under heat and pressure so as to establish a thin smooth surfaced unitary structure or uniform wall thickness.

The core C is established of a multiplicity of layers of Kevlar 29 fabric, or an equivalent thereof. The layers are laid in surface to surface engagement with each other and under sufficient pressure to cause them to conform to the shape of the inner surface of the shell and to prevent planar shifting of the laminates relative to each other. In practice, there need only be about eight layers F′ of fabric as shown in the core C and the layers need only be held together under about 3 or 4 pounds per square inch.

The inner liner I is eatablished of soft, resilient material and is of sufficient thickness to allow for anticipated inward displacement of the adjacent core materials without excessive or undue inward collapsing of the liner, when the core material is displaced inwardly in advance of a bullet impinging upon and advancing inwardly into the structure.

In practice, an inner liner of resilient foam plastic sold by U.S. Rubber Co. under the tradename "INSOLITE" and about ¾ inch thick, has proven to be satisfactory.

Further, in practice, if desired, by adding a number of layers of fabric F′ to the core C, the required thickness of the liner I can be reduced. For example, by adding 4 layers of fabric to the core and increasing the thickness of the core about one-quarter inch, the thickness of the liner can be effectively reduced to about one-third inch.

In practicing the invention, I have employed various polypropylene and polyurethane resilient shock absorbing foam plastic sheet stock with satisfactory results and have determined that substantially any liner material of the general character referred to and which is sufficiently resilient so that it will not compact into a substantially solid non-yielding form, or state, can be employed.

In FIGS. 5 through 8 of the drawings, I have illustrated the manner in which the wall structure that I provide receives and stops a 357 Magnum bullet fired at the structure in accordance with the test procedures formulated by the government and which have been previously considered.

Figures 3, 4, 5, 6, 7, 8, 9, 10:
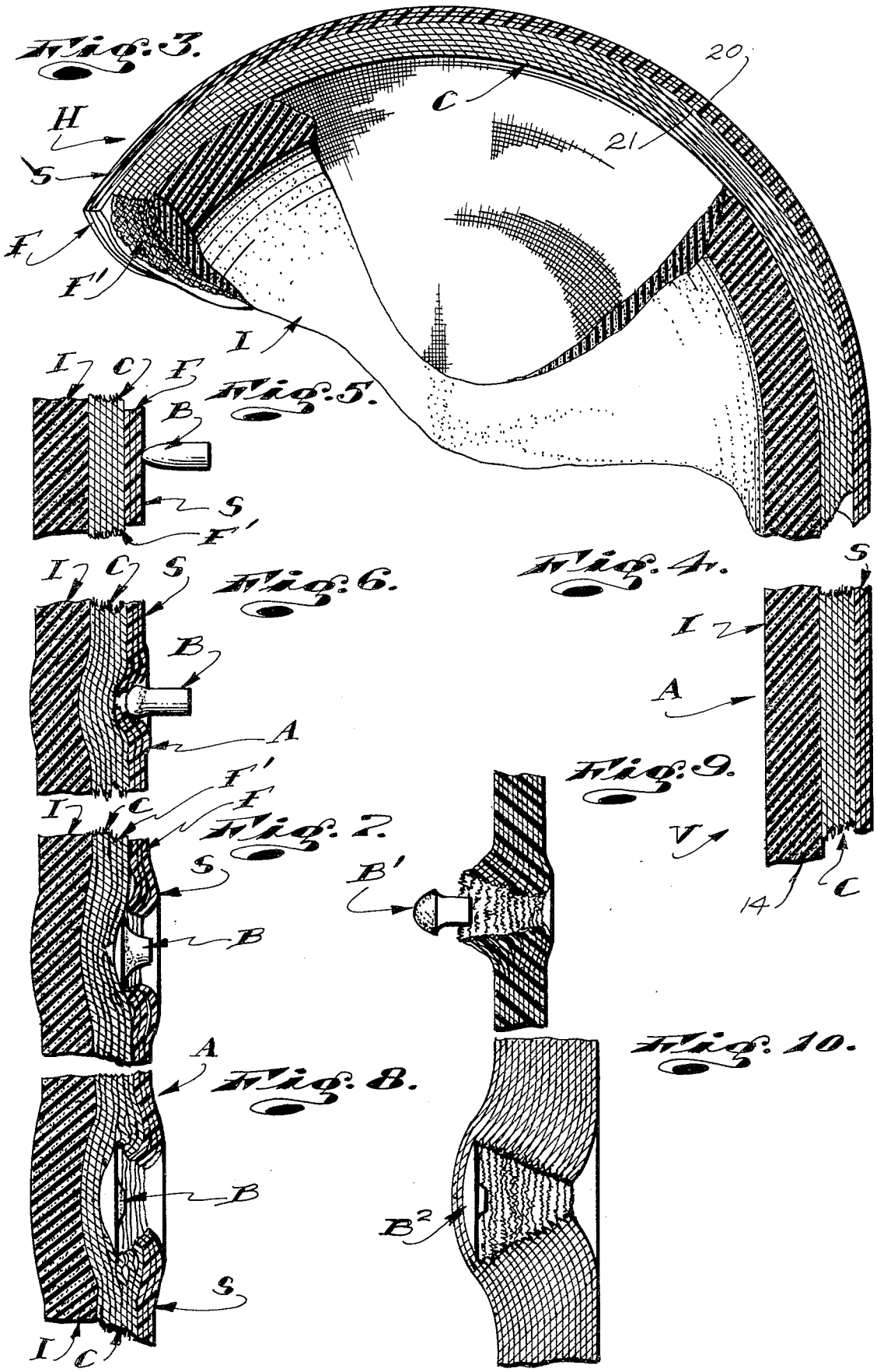
FIG. 3 is a sectional view of portions of the helmet structure, shown in FIG. 1, with portions of the structure broken away to better illustrate the construction.
FIG. 4 is a sectional view of a portion of one panel section of the vest that I provide.
FIGS. 5 through 8 are a sequential series of sectional views illustrating the manner in which the wall structure receives and stops bullets.
FIG. 9 is a view illustrating the manner in which a bullet penetrates a resin impregnated laminated fabric wall structure.
FIG. 10 is a view illustrating the manner in which a bullet is received and stopped by a wall structure of loose non-secured fabric laminates.

In FIG. 5 a bullet B is shown establishing initial contact with the surface 20 of the skin S.

FIG. 6 illustrates the general manner in which the skin S initiates deformation of the bullet B, ruptures and yields under the force of the bullet, to absorb, dispute and distribute force. The manner in which the core is acted upon and first caused to yield by the skin and the manner in which the liner first yields under forces transmitted thereto through the core is also illustrated.

FIG. 7 illustrates the approximate extent to which the bullet B is believed to be deformed by the time it has fully penetrated the skin S, the extent to which the skin has been deformed and the manner and extent to which the core C and liner I have been deformed. It is believed that at this time, the first or outermost fabric layer F of the core is likely to have been ruptured.

It is to be noted that by the time the bullet B has penetrated the skin S, it has deformed radially considerably and presents a substantially increased cross-sectional area in contact with the core C.

In FIG. 8 of the drawings, I have illustrated the relationship of parts which exists when the bullet has been stopped and is at rest within the wall structure. It is to be noted that the bullet B is extensively deformed and has fully penetrated but two layers of the core C, that the remaining three layers of the core and the liner I have deformed to a greater extent and that the structure of the wall through which the bullet had previously passed has yielded and deformed to a greater extent as a result of the forces of the bullet which have been directed thereto and spent therein.

The foregoing explanation and referred to illustrations of the manner in which my structure stops bullets has been developed and/or theorized by careful examination of the results of many test firings and by comparison of those results with the results of test firings into other test wall structures made up of the same or similar materials. It is understood that the subject explanation and illustrations may be over simplified and may be subject to some error, but as presently advised, they are believed to be substantially correct.

In FIG. 9 of the drawings, I have illustrated the general extent to which a bullet B′ is deformed by a wall structure of eight layers of Kevlar 29 fabric impregnated and bonded together by the same resin as is employed in establishing the skin S and the general manner in which that wall structure is pierced and deformed by the bullet B′. It is significant to note that this wall structure is readily penetrated by the bullet and that the bullet is deformed to a lesser extent than is the bullet B by the time it has penetrated the core supported or backed three layer skins S of the present invention.

In FIG. 10 of the drawings, I have illustrated the general results of test I have conducted which consisted of firing bullets into a wall structure similar to my core structure, but which consisted of approximately 15 layers of Kevlar 29 fabric. It is to be noted that in these tests, as illustrated, the bullets $B^2$ penetrated about 12 or 13 layers of fabric before coming to rest. It is to be particularly noted that in these tests, the outer surface layers of the wall structure yielded directly inwardly in advance of the bullet and that there were no signs or indication of any forces having been directed radially and outwardly as is the case in the present invention and as in the fully integrated wall structure shown in FIG. 9 of the drawings.

Since an integrated wall structure such as shown in FIG. 9 of the drawings is extremely inefficient to stop bullets and since the loose or non-integrated laminated wall structure shown in FIG. 10 is noticeably and greatly less efficient to stop bullets than the wall structure of the present invention; it can be readily and properly deduced that the combination of integrated and non-integrated wall structures wherein the non-integrated structure backs and supports the integrated structure with respect to the forces directed thereto by a bullet, is far more effective to stop bullets than either of the component wall structures of which it is established. The increase of effectiveness is sufficient so that both of the component wall structures can be made substantially thinner and lighter than either of the component structures alone. The decrease in weight and thickness is such that the thickness and weight of the resulting wall structure is less than a necessary and effective bullet stopping thickness and weight of one or the other of the laminated component structures (skin or core) alone.

Figure 12:
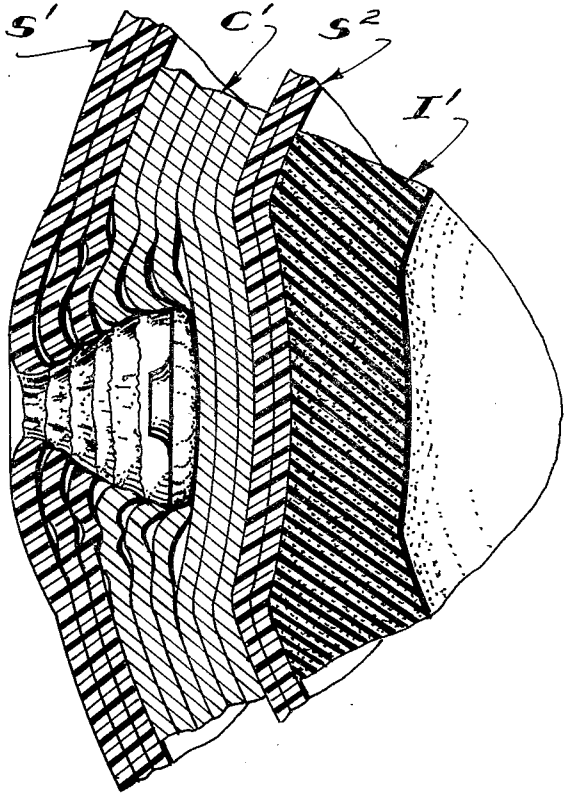
FIG. 12 is a view similar to FIG. 11 illustrating the manner in which the wall structure moves upon viewing and stopping a bullet.
Figure 11:
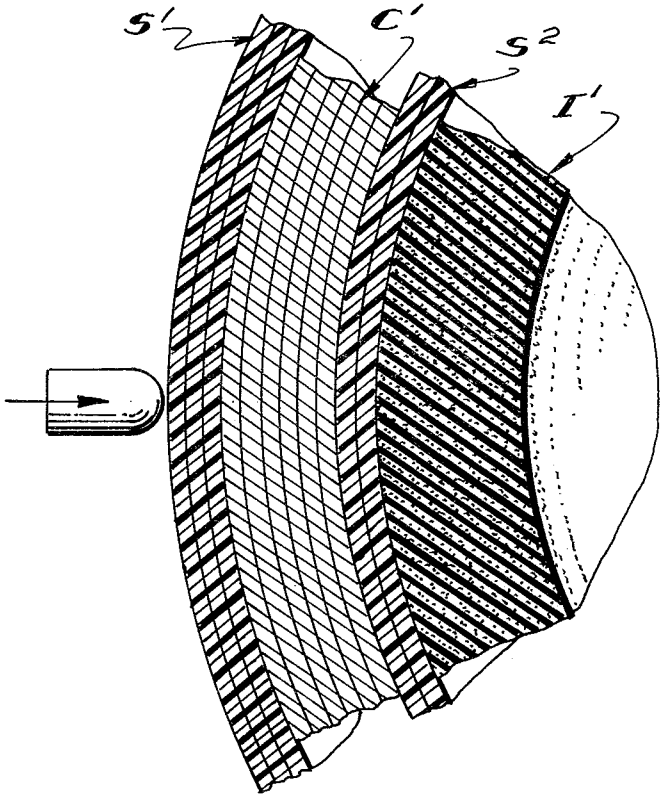
FIG. 11 is a sectional view of a portion of a modified wall structure provided by my invention.

In furtherance of my invention and as shown in FIGS. 11 and 12 of the drawings, I provide an inner skin $S^2$ similar, but lighter in weight than the outer skin or shell S′, between which the non-integrated laminated core C′ is arranged and on the inner surface of which the resilient inner liner I′ is arranged and secured as by means of a suitable cement.

In practice, the skin $S^2$ need only be a two-ply integrated or resin impregnated and bonded laminated structure.

In operation, the inner skin $S^2$ yieldingly and resiliently backs up the core C′ and serves to or effects a wider and more uniform radial distribution of the forces directed into and delivered toward the inner liner I′ by the core. The inner skin $S^2$ also serves to reflect and/or redirect some of the forces radially and outwardly, back into the core C′ and to the outer skin S′, as has been evidenced by a general increase in wall thickness and a generally larger affected area of this second form of wall structure, at and about a shot or bullet impact point. The normal effect of a shot is illustrated, generally, in FIG. 12 of the drawings.

Having described only one typical preferred form and application of my invention, I do not wish to be limited or restricted to the specific details herein set forth, but wish to reserve to myself any modifications and/or variations that may appear to those skilled in the art to which this invention pertains.

Having described my invention, I claim:

1. A bullet-proof body-protecting wall structure comprising a thin resilient integrated laminated flexible woven fabric and a resin impregnated outer skin with inner and outer surfaces, a non-integrated laminated flexible woven fabric core with inner and outer surfaces arranged with its outer surface adjacent the inner surface of the outer skin to yieldingly support said skin against inward deflection and a soft resilient inner liner with inner and outer surfaces and arranged with its outer surface adjacent the inner surface of the core to yieldingly support said core against inward deflection, said inner surface of the inner liner adapted to be disposed substantially adjacent to a portion of the body to be protected and said outer surface of the outer skin adapted to be disposed substantially normal and opposite to the line and direction of flight of a bullet directed toward said portion of the body.

2. A wall structure as set forth in claim 1 wherein the fabric is woven of long chain polyester resin fibers having high indexes off shear and tension and a high melting point, said resin impregnating and bonding the fabric of the skin having lower indexes of shear and tension than said fibers.

3. A wall structure as set forth in claim 1 which further includes an inner skin similar in structure to the outer skin and disposed between the inner surface of the core and the outer surface of the liner.

4. A wall structure as set forth in claim 1 wherein the outer skin is molded to substantially conform to the configuration of the portion of the body to be protected and to occur in substantially predetermined spaced relationship with said portion of the body, said core and said liner being shaped to conform with the shape of the outer skin and with each other.

5. A wall structure as set forth in claim 1 wherein the outer skin is molded to substantially conform to the configuration of the portion of the body to be protected and to occur in substantially predetermined spaced relationship with said portion of the body, said core and said liner being shaped to conform with the shape of the outer skin and with each other, wherein the fabric is woven of long chain polyester resin fibers having high indexes of shear and tension and a high melting point, said resin impregnating and bonding the fabric of the skin having lower indexes of shear and tension than said fibers.

6. A wall structure as set forth in claim 1 wherein the outer skin is molded to substantially conform to the configuration of the portion of the body to be protected and to occur in substantially predetermined spaced relationship with said portion of the body, said core and said liner being shaped to conform with the shape of the outer skin and with each other, said structure includes an inner skin similar in structure to the outer skin and disposed between the inner surface of the core and the outer surface of the liner.

7. A wall structure as set forth in claim 1 wherein the fabric is woven of long chain polyester resin fibers having high indexes of shear and tension and a high melting point, said resin impregnating and bonding the fabric of the skin having lower indexes of shear and tension than said fibers, said structure includes an inner skin similar in structure to the outer skin and disposed between the inner surface of the core and the outer surface of the liner.

* * * * *